United States Patent [19]

Alvarez

[11] Patent Number: 4,981,077

[45] Date of Patent: Jan. 1, 1991

[54] DAMPENING APPARATUS FOR LITHOGRAPHIC PRESS

[75] Inventor: Michael A. Alvarez, Kinnelon, N.J.

[73] Assignee: Varn Products Company, Oakland, N.J.

[21] Appl. No.: 383,380

[22] Filed: Jul. 20, 1989

Related U.S. Application Data

[63] Continuation-in-part of Ser. No. 203,351, Jun. 6, 1988, abandoned.

[51] Int. Cl.[5] ..... B41F 7/26; B41F 7/40

[52] U.S. Cl. ..... 101/148; 101/350

[58] Field of Search ..... 101/147, 148, 349, 350, 101/363, 364, 351, 352, 348, 207-210

[56] References Cited

U.S. PATENT DOCUMENTS

| | | | |
|---|---|---|---|
| 2,796,078 | 6/1957 | Ebersole | 137/454 |
| 2,922,364 | 1/1960 | Nitchie et al. | 101/364 |
| 3,041,967 | 7/1962 | Nystrand | 101/247 |
| 3,326,122 | 6/1967 | Wildeman | 101/148 |
| 3,343,484 | 9/1967 | Dahlgren | 101/148 |
| 3,404,625 | 10/1968 | White | 101/148 |
| 3,561,360 | 2/1971 | Branfield et al. | 101/366 |
| 3,701,316 | 10/1972 | Sylvester et al. | 101/148 |
| 3,749,011 | 7/1973 | Abendroth et al. | 101/148 |
| 3,769,909 | 11/1973 | Fugman et al. | 101/148 |
| 4,036,131 | 7/1977 | Elmore | 101/247 |
| 4,088,074 | 5/1978 | Dahlgren et al. | 101/350 |
| 4,130,057 | 12/1978 | List et al. | 101/148 |
| 4,208,963 | 6/1980 | Dahlgren | 101/148 |
| 4,309,945 | 1/1982 | Marion | 101/247 |
| 4,373,442 | 2/1983 | Dahlgren et al. | 101/148 |
| 4,395,947 | 8/1983 | Despot | 101/148 |
| 4,411,193 | 10/1983 | Hess | 101/148 |
| 4,453,463 | 6/1984 | Dahlgren et al. | 101/148 |
| 4,455,938 | 6/1984 | Loudon | 101/148 |
| 4,538,514 | 9/1985 | Simeth | 101/148 |
| 4,590,855 | 5/1986 | Schommer et al. | 101/157 |
| 4,643,090 | 2/1987 | McKrell et al. | 101/220 |

FOREIGN PATENT DOCUMENTS

| | | |
|---|---|---|
| 1249885 | 9/1967 | Fed. Rep. of Germany . |
| 3614704A1 | 4/1986 | Fed. Rep. of Germany . |

OTHER PUBLICATIONS

Varn Products Co., Inc.; May 1980, "Offer Automatic Dampening System for Small Press Sizes".

Print Action; "Varn Intros Kompac Auto Dampening System"; Page eleven; Aug. 1980; Printaction.

John MacPhee; "Trends in Litho Dampening System Show Vast Improvements in Designs"; Apr. 1981; Graphics Arts Monthly P.G. 3.

Varn Products Co., Inc., "Kompac II Automatic Dampening System"; Model Specifications, 1983, Varn Products Co., Oakland, N.J.

*Primary Examiner*—J. Reed Fisher

*Attorney, Agent, or Firm*—Biebel, French & Nauman

[57] ABSTRACT

A dampener for a lithographic press comprises a form roller, a metering roller, a reservoir of dampening solution lying above and between the form and metering rollers, and means for supplying solution to the reservoir. The amount of solution applied to the form roller is controlled by adjusting the pressure between the form and metering rollers, without appreciably affecting the pressure between the form roller and the plate cylinder. Excess moisture retained on the form roller and excess solution which collects between the plate cylinder and the form roller is continuously returned directly to the reservoir. The metering roller and the plate cylinder are driven by the press gear drive system, and the form roller is driven from frictional contact with the plate cylinder and the metering roller, to aid in retrofitting the dampener to existing presses. The dampener mechanism can also be used alternatively to supply water-based coating liquids to allow use of the press for a coating operation.

11 Claims, 3 Drawing Sheets

DAMPENING APPARATUS FOR LITHOGRAPHIC PRESS

CROSS-REFERENCE TO RELATED APPLICATION

This application is a continuation-in-part of Ser. No. 203,351 filed Jun. 6, 1988, now abandoned.

BACKGROUND OF THE INVENTION

The present invention relates to dampening systems for offset lithographic printing presses, and more particularly, to an improvement in the dampening solution feed apparatus which is disclosed in U.S. Pat. No. 4,455,938.

The major components of a typical offset press are the plate cylinder, blanket cylinder, dampening system, and inking system. Secured around the plate cylinder is a planographic printing plate upon which is imposed an image defined by a gradation of oleophilic dots or areas and a hydrophilic background, the intensity of the image being directly proportional to the concentration of such dots and/or the shape of such areas.

The function of the dampening system is to thoroughly moisten only the background of the plate with a substantially aqueous solution. Grease-based ink is applied to the plate and adheres only to the oleophilic dots to create an inked image which is transferred to an adjacent blanket cylinder and subsequently to the paper to be printed. Prior to the invention disclosed in said U.S. Pat. No. 4,455,938, the most common dampening devices used in offset lithographic presses were either of the type disclosed in U.S. Pat. No. 4,088,074 issued 9 May 1978, or of the oscillating ductor roller type which has been used in this art for many years.

The dampening system is a critical element of the press. If the quantity and application of the dampening solution is not precise, the solution and ink will incorrectly coat the respective hydrophilic and oleophilic areas, and the finally printed image will be distorted. Conventional ductor roller dampening systems control the amount of solution transferred to the form roller, which contacts the plate cylinder, by adjusting the rate of oscillations of the ductor roller which reciprocates back and forth from a solution reservoir to the train of dampening rollers.

The amount of solution which is then actually transferred to the plate is controlled by adjusting the pressure between the form roller and the plate cylinder. Excess solution is nipped between the form roller and the plate cylinder and accumulates on the form roller. This excess solution must eventually be reduced by decreasing the number of oscillations of the ductor roller, or it will accumulate enough to result in overmoistening of the printing plate. This is accomplished by the dampening apparatus of U.S. Pat. No. 4,455,938, and as a result it has enjoyed considerable success as a replacement or retrofit dampener for a number of small printing presses marketed by various companies. Depending upon the existing press structure, the dampener may take various configurations so as to adapt to and receive its drive from such presses.

While dampeners of the type disclosed in said U.S. Pat. No. 4,455,938 are useful with many sizes and types of lithographic presses, these dampeners in a 11 inch by 17 inch (279 mm. by 432 mm.) sheet-fed presses which are used in small to medium size printing establishments, often called "job shops" in the trade. Those shops may also have need for an over-coating (e.g. varnishing) function, using water-based transparent coatings to enhance the appearance of a printed page. Special attachments to such presses, for coating the back side of sheets via the impression cylinder, are known. One such attachment is disclosed in published German patent application DE No. 36 14 704 Al.

The possibility of using a dampener, alternatively, as a coater, represents considerable savings in equipment investment to such shops, which often have budget restraints.

SUMMARY OF THE INVENTION

The present invention is a dampening apparatus for offset lithographic printing presses which incorporates the novel features and arrangements of the dampening apparatus disclosed in U.S. Pat. No. 4,455,938, namely, a form roller supported parallel and tangent to the plate cylinder, a metering roller supported parallel and tangent to the form roller and pressed into contact therewith, a reservoir of dampening solution for the metering roller, preferably lying above and between the form and metering rollers, and a means for regularly supplying solution to the reservoir to maintain the reservoir level.

The form roller surface moves at a speed which matches the speed of the plate cylinder surface (and thus the speed of the plate) and also matches the surface speed of the metering roller. In the original design this is accomplished by gearing the plate cylinder and form roller together, and preferably but not necessarily also gear driving the metering roller. As described in the U.S. patent, by means of such dampening apparatus an excessive amount of dampening solution is always in contact with the form roller. The amount of solution actually applied is controlled by adjusting the pressure between the form and metering rollers and between the form roller and the plate cylinder. Excess moisture which is retained on the form roller then is continuously returned directly to the reservoir, thus the solution does accumulate and eventually over-dampen the plate.

The form roller has a surface which is compressible and ink receptive, and the metering roller has a surface which is much more rigid than the form roller and which is also ink receptive. In operation no attempt is made to prevent or minimize the transfer of ink from the inked plate onto the dampening form roller and metering roller. Instead, contrary to the accepted practice, no effort is made to avoid such ink transfer into the dampener, and upon commencing a printing operation the liquid in the reservoir quickly becomes an emulsion of ink and dampening solution.

In the improvement of the present invention, to simplify and make easy retrofitting the dampening apparatus into existing lithographic presses, the metering roller and the plate cylinder are mechanically driven directly by the press gear drive system, and the form roller is driven from frictional contact with both the plate cylinder and the metering roller. Thus, the surface velocities of the metering and form rollers and a plate on the plate cylinder are equilibrated.

The form roller is mounted such that its axis of rotation can be moved parallel to a tangent to the plate cylinder surface, while keeping a parallel relation with the axis of rotation of the plate cylinder and the metering roller. This allows a change in the pressure at the form roller/metering roller nip without affecting the pressure of the form roller against the plate. Also, this adjustment can be made so as to increase the pressure at the form roller/metering roller nip with increase in press speed, for controlling any tendency to transfer excess dampening solution at such higher speeds.

In accordance with another aspect of the present invention, the dampening solution can be replaced with an aqueous based coating liquid. A plain generally smooth plate is mounted on the plate cylinder for accepting a uniform liquid coating and for transferring it to material, such as pre-printed sheets, fed through the press.

It is, therefore, the primary object of the present invention to provide an improvement in the prior art dampening apparatus for offset printing presses incorporating the aforementioned features; to simplify the gearing system over that of the prior art; to provide an improved gearing system for retrofit into offset lithographic printing presses; to provide a system whereby the pressure of the dampening form roller against the plate can be set to a desired value, and wherein pressure between the form and metering rollers can be increased at higher press speed without changing the form roller to plate pressure; and to provide a dampening apparatus which may supply coating materials to permit a coating operation using an existing press and mounting brackets, etc.

Other objects and advantages of the present invention will be obvious to persons skilled in the art in view of the following detailed description.

DESCRIPTION OF THE PREFERRED EMBODIMENT

Figure 1:
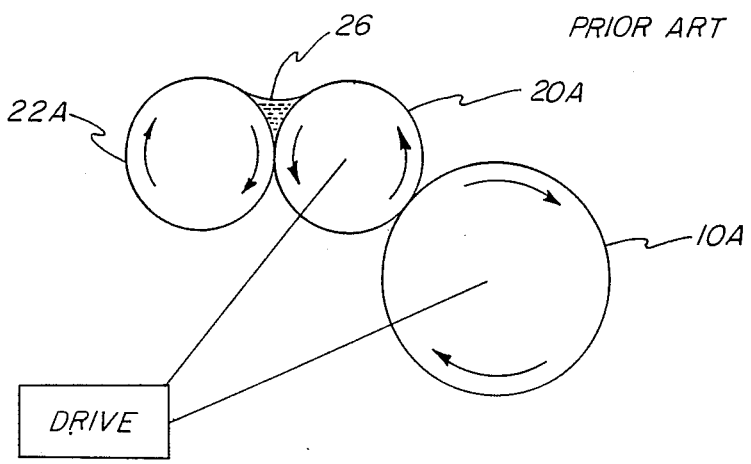
FIG. 1 is a schematic view of the existing dampening apparatus showing the form roller positively gear driven from the plate cylinder, and the metering roller being driven from frictional contact with the form roller, as explained in U.S. Pat. No. 4,455,938.

FIG. 1 shows the existing dampening apparatus, which is disclosed in U.S. Pat. No. 4,455,938 and incorporated herein by reference. As shown a plate cylinder **10*a* has a dampening form roller 20*a* pressed against it, and a metering roller 22*a* is pressed against the form roller, providing a nip in which the upper part forms a reservoir 26 for dampening solution. The form roller 20*a* is positively gear driven from plate cylinder 10*a*, and metering roller 22*a* is frictionally driven from the form roller 20*a* due to the pressure contact therebetween. Alternately, metering roller 22*a* can be gear driven from form roller 20*a***.

Figure 2:
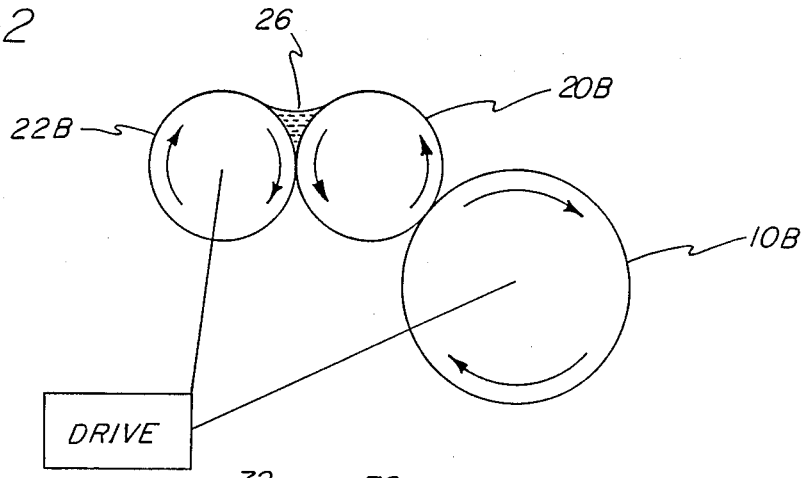
FIG. 2 is a schematic view similar to FIG. 1, showing the present invention in which the metering roller and the plate cylinder are gear driven by the press gear drive system, and the form roller is driven due to its the frictional contact with both the plate cylinder and the metering roller.

As shown in FIG. 2 the improvement of the present invention has the plate cylinder **10*b* and the metering roller 22*b* mechanically driven by the existing gear drive system of the press. It is necessary only to add gears as appropriate to transfer the drive to the metering roller, since the plate cylinder is already gear driven. The form roller 20*b* is driven from frictional contact with plate cylinder 10*b* and metering roller 22*b*, since the form roller is positively pressed against both of them, particularly against the form roller 20*b***.

It should be apparent that in the drive arrangement of this system the same dampening function is retained as the dampening system disclosed in U.S. Pat. No. 4,455,938, but in certain cases this arrangement is more readily adaptable for retrofitting into existing offset lithographic printing presses. The ends of the reservoir above the form roller/metering roller nip are provided by seals 25 (FIG. 3) which engage the radial ends of the form roller **20*b* and the peripheral ends of the metering roller 22*b***, in the same manner as described in detail in U.S. Pat. No. 4,455,938.

Figure 3:
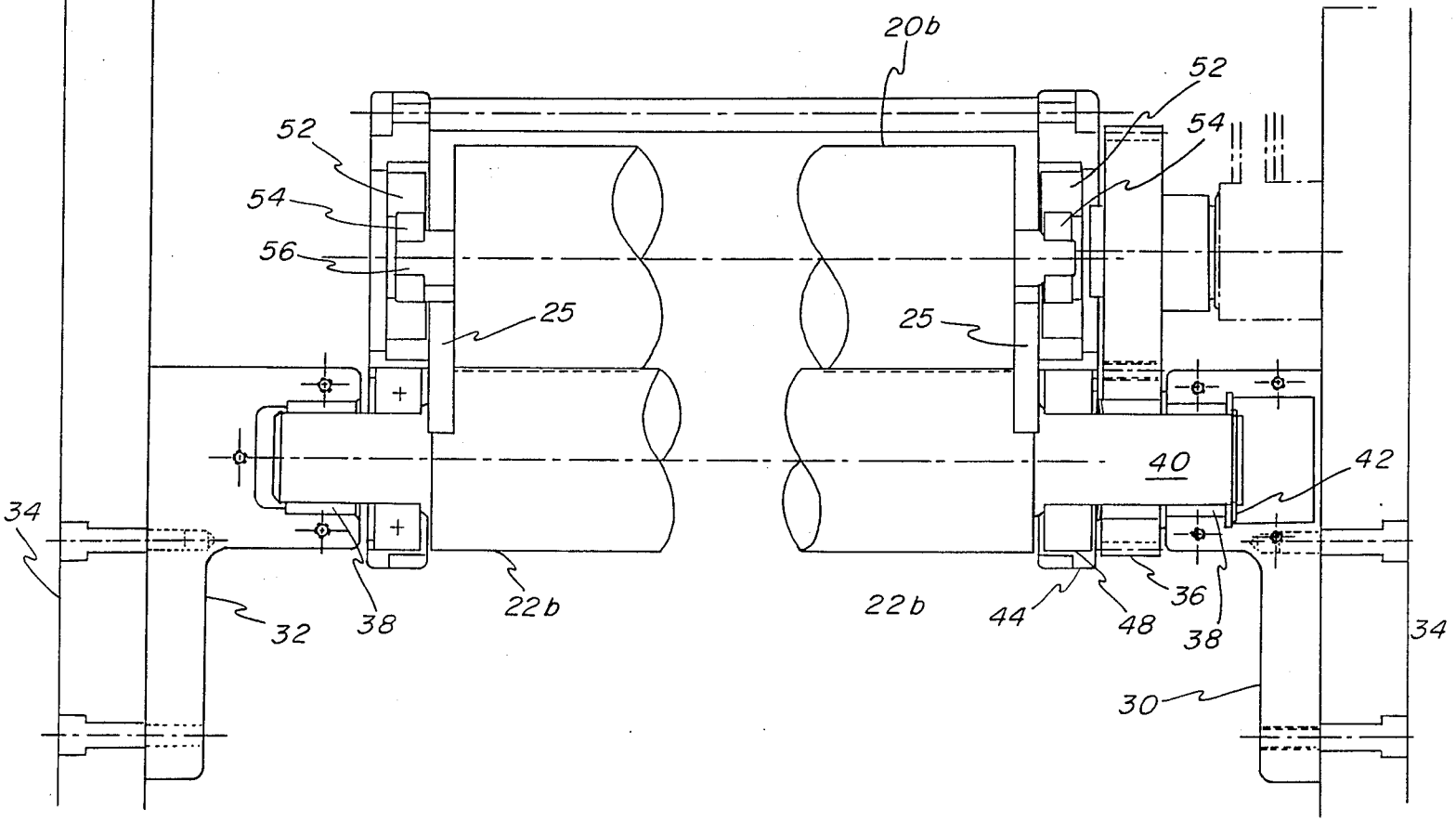
FIG. 3 is a foreshortened top view of a retrofit type dampener constructed according to the invention.

Referring to FIG. 3, a pair of support brackets 30 and 32 are fastened (as by bolts) to the side frame members 34 of a press. Gear 36 represents a final gear in a train driven from the press drive, and from which rotary power at appropriate speed can be taken to the metering roller **22*b*. Brackets 30 and 32 support roller bearings 38 which in turn receive the extended ends of the shaft 40 of metering roller 22*b*. A snap ring 42 is fitted to one end of shaft 40, outboard of bearing 38 in bracket 30, to locate the dampening unit laterally in brackets 30, 32**.

Figure 5:
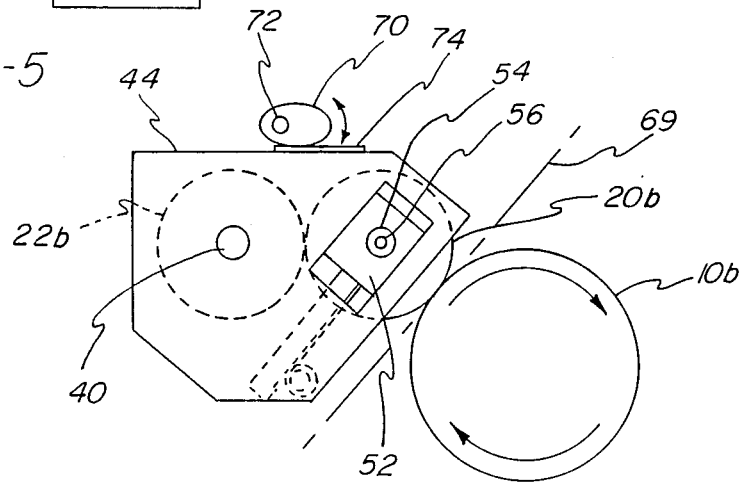
FIG. 5 is a side elevation view showing a dampener frame member, illustrating the adjustment of the metering roller/form roller pressure, and the adjustment of the form roller/plate cylinder pressure.
Figure 4:
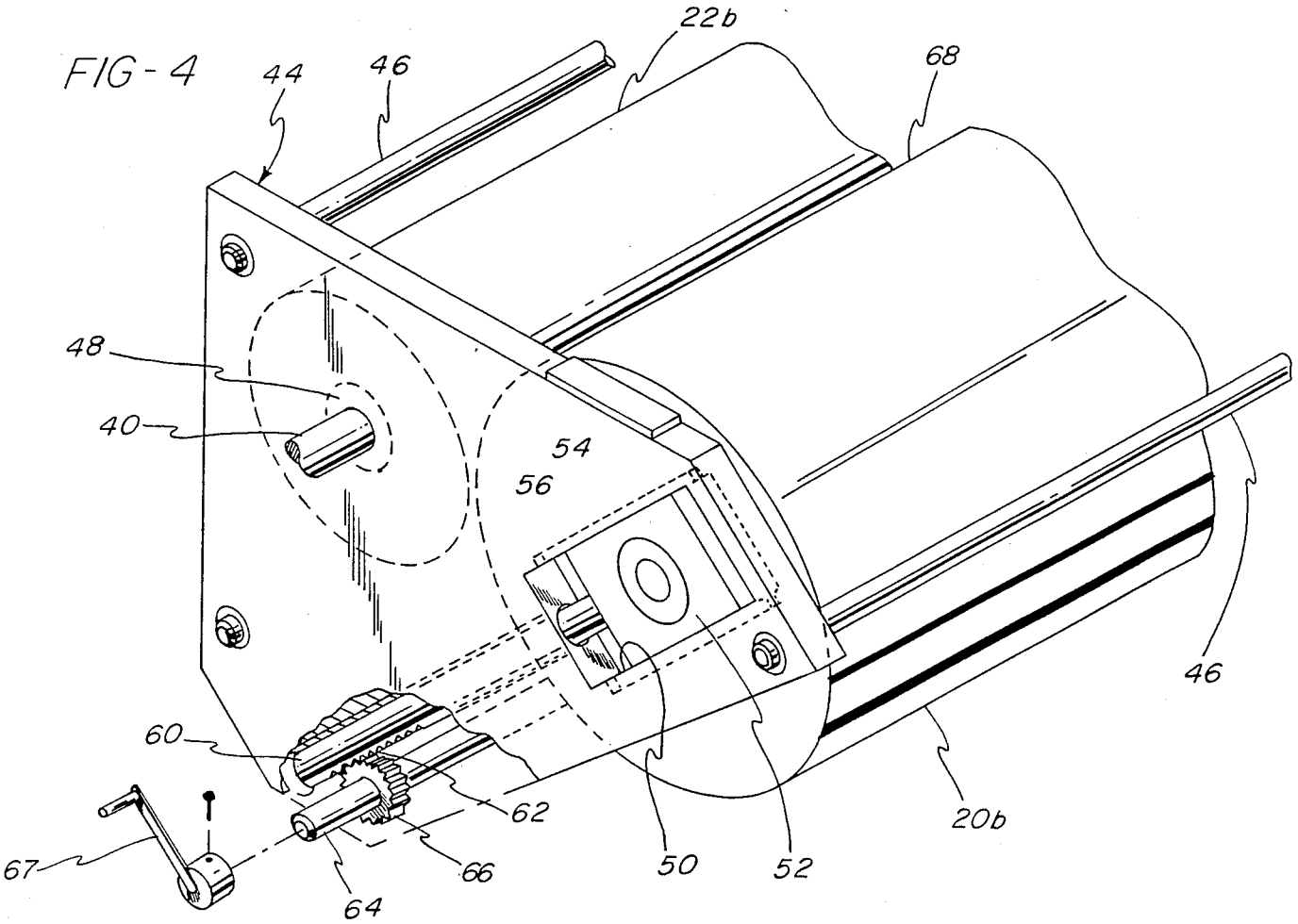
FIG. 4 is a perspective exploded view of the dampener, illustrating the adjustment of metering roller/form roller pressure.

As shown in FIGS. 4 and 5, the structure of the dampener apparatus itself includes side frame members 44 connected by cross rods 46, which are pinned or otherwise fastened at their ends to frame members 44. Those frame members include bearings 48 receiving the metering roller shaft 40, and elongated slots 50 which receive blocks 52 that can slide in the slots 50 in a direction generally tangential to form roller **20*b*. Each block 52 includes a roller bearing 54 which receives an end of the form roller shaft 56, supporting the form roller 20*b* parallel to and in contact with the metering roller 22*b*. Thus, as can be perceived from FIGS. 4 and 5, the dampener apparatus itself is rotatable about the centerline of metering roller shaft 40**.

Extending from blocks 52, through guide bores 58 in the dampener frame members, are adjustment or control rods 60 which are formed with a number of gear teeth to provide a short rack 62. A shaft 64, having small gears 66 thereon, extends between the dampener frame members 44 and is rotatable by a handle 67 pinned to shaft 64, to move control rods 60 in unison, thereby to move the form roller **20*b* toward and away from the metering roller 22*b* to adjust the pressure at their nip 68. The region above that nip functions (as is known) as the reservoir 26 for dampening solution. Due to the arrangement of the slots at a tangent 69 to the plate cylinder 10*b* such adjustment of the metering-/form roller pressure does not affect the pressure of the form roller 20*b* against the plate. Furthermore, since the seals 25 engage the radial ends of the form roller 20*b***, adjusting motion of that roller as just described does not affect the sealing action.

It has been noted that after the dampener has been adjusted at slow press speeds (e.g. below 350 rev./min.) to obtain the proper application of dampening solution, a substantial increase in press speed (e.g. to 1000 rev./-min. or more) can result in excess dampening of the plate. The above-described adjustment feature is therefore also useful to provide pre-set increase in form roller/metering roller nip pressure. This may be accomplished manually by setting the handle to a predetermined position, or by a suitable form of manually or automatically actuated mechanism (not shown) which will rotate shaft 64 appropriately to increase this nip pressure to the level desired.

The pressure of the form roller **20*b* against the plate on cylinder 10*b* is achieved by the cams 70, fixed to a cross-shaft 72, pressing on a wear plate or follower 74 at the top of each frame member 44. Movement of this mechanism (which is per se known) pre-sets the position of the dampener frame, so as to exert a predetermined pressure of the form roller 20*b* against a plate on plate cylinder 10*b***.

A modification of the above-described embodiment includes thoroughly cleaning the reservoir 26 and replacing the dampening solution with a liquid such as an aqueous based coating liquid, varnish or the like. A plain generally smooth plate is mounted on the plate cylinder **10*b*** for accepting a uniform liquid coating and for transferring it to sheets fed through the press on a separate run for coating purposes.

It should be apparent to one skilled in the art that the coating liquid can be prevented from drying to the rollers while the press is idling, such as during the time between coating jobs, by a conventional gear and clutch system (not shown) which would permit the roller drive system to operate without operating the press.

While the forms of apparatus herein described constitute a preferred embodiment of this invention, it is to be understood that the invention is not limited to these precise forms of apparatus, and that changes may be made therein without departing from the scope of the invention which is defined in the appended claims.

What is claimed is:

1. A dampener for an offset lithographic printing press having a plate cylinder on which a lithographic plate can be mounted, said dampener comprising:

a frame adapted for mounting on the press adjacent the plate cylinder;

a form roller rotatably supported in said frame for contact with a plate on the plate cylinder;

a metering roller rotatably supported in said frame in pressure contact with said form roller and on the opposite side thereof from the plate cylinder and forming with said form roller a reservoir for dampening solution;

said form roller and said metering roller having ink receptive surfaces and the surface of said metering roller being substantially less resilient than the surface of said form roller;

means for urging said form roller into contact with a plate on the plate cylinder;

means urging said metering roller and said form roller into pressure contact with each other; and means providing a supply of dampening solution to said reservoir whereby solution in said reservoir is continually mixed with ink picked up from the plate by the action of the metering and form rollers and the resulting emulsion of solution and ink is applied to the plate by said form roller;

the improvement comprising means for adjusting the pressure contact between said metering roller and said form roller without changing the pressure contact between said form roller and the plate cylinder;

drive gear means rotating said plate cylinder and said metering roller at one-to-one surface speed with each other; and said form roller being driven from frictional contact with said plate cylinder and said metering roller.

2. A dampener for an offset press as defined in claim 1, further comprising:

a shaft supporting said metering roller;

bearing means supporting said metering roller in said frame with portions of said shaft extending outwardly from said frame;

a pair of mounting brackets adapted for attachment to the press;

a bearing in each of said brackets receiving an end of said shaft to provide a mounting for said frame coincident with the axis of said shaft.

3. A dampener for an offset press as defined in claim 1, further comprising:

slots formed in said frame arranged parallel to a tangent to said plate cylinder;

blocks slidably mounted in said slots;

bearings in said blocks receiving the ends of said form roller;

bearings supported in said frame and receiving ends of said metering roller in spaced relation to said slots;

control rods attached to said blocks; and said means for adjusting the pressure contact between said metering roller and said form roller including means acting on said control rods to move said blocks in a direction to move the axis of said form roller toward and away from the axis of said metering roller.

4. A dampener for an offset lithographic printing press having a plate cylinder on which a lithographic plate can be mounted, said dampener comprising:

a frame adapted for mounting on the press adjacent the plate cylinder;

a form roller rotatably supported in said frame for contact with a plate on the plate cylinder;

a metering roller rotatably supported in said frame for contact with said form roller and on the opposite side thereof from the plate cylinder and forming with said form roller a nip, the regions of said metering roller and form roller above such nip providing a reservoir for dampening solution;

means urging said form roller into pressure contact with said metering roller;

said form roller and said metering roller having ink receptive surfaces and the surface of said metering roller being substantially less resilient than the surface of said form roller;

means for urging said form roller into contact with a plate on the plate cylinder; and means providing a supply of dampening solution to said reservoir whereby solution in said reservoir is continually mixed with ink carried from the plate by said form roller and the resulting emulsion of solution and ink is applied to the plate by said form roller;

the improvement comprising means for adjusting the pressure contact between said metering roller and said form roller without changing the pressure contact between said form roller and the plate cylinder;

drive means rotatably connected to the plate cylinder and to said metering roller and said form roller being driven from frictional contact with the plate cylinder and said metering roller, said form roller and said metering roller rotating in opposite directions at substantially the same surface speed such that the contacting portions thereof move downwardly through the nip and said form roller carries a mixture of ink and dampening solution from said nip onto a plate on the plate cylinder at the same surface speed as the plate.

5. A dampener for an offset press as defined in claim 4 wherein said metering roller has shaft ends extending from its opposite ends;

bearing means supporting said shaft ends in said frame with portions of said shaft ends extending outwardly from said frame;

a pair of mounting brackets adapted for attachment to the press;

a bearing in each of said brackets receiving one of said shaft ends providing a mounting for said frame coincident with the axis of said shaft and about which said frame can rotate to move the surface of said form roller toward and away from the plate cylinder.

6. A dampener for an offset press as defined in claim 4, further comprising:

slots formed in said frame arranged parallel to a tangent to the plate cylinder;

blocks slidably mounted in said slots;

bearings in said blocks receiving the ends of said form roller;

bearings supported in said frame and receiving ends of said metering roller in spaced relation to said slots;

said means for adjusting the pressure contact between said metering roller and said form roller including means acting on said blocks to move the axis of said form roller toward and away from the axis of said metering roller while maintaining the pressure of the form roller against a plate on the plate cylinder.

7. A dampener for an offset lithographic printing press having a plate cylinder on which a lithographic plate can be mounted, said dampener comprising:

a frame adapted for mounting on the press adjacent the plate cylinder;

a form roller rotatably supported in said frame for contact with a plate on the plate cylinder;

a metering roller in pressure contact with said form roller on the opposite side thereof from the plate cylinder and forming with said form roller a reservoir for damping solution;

bearings in said frame supporting said metering roller along a fixed axis parallel to the plate cylinder and spaced therefrom by a distance less than the diameter of said form roller;

spaced apart guide means on said frame arranged parallel to a tangent to said plate cylinder and extending along a path located between said metering roller and the plate cylinder;

bearings in said guide means receiving the ends of said form roller;

means acting on said guide means to move said form roller in a direction tangent to the plate cylinder and toward and away from said metering roller for urging said metering roller and said form roller into pressure contact without affecting the contact of said form roller with a plate on the plate cylinder;

means providing a supply of damping solution to said reservoir whereby solution in said reservoir is continually mixed with ink picked up from the plate by the action of the metering and form rollers and the resulting emulsion of solution and ink is applied to the plate by said form roller;

drive means rotating said plate cylinder and said metering roller at one-to-one surface speed with each other and said form roller being driven from frictional contact with the plate cylinder and said metering roller.

8. Apparatus for applying a metered amount of a liquid to an offset lithographic printing press having a plate cylinder on which a lithographic plate can be mounted, said apparatus comprising:

a frame adapted for mounting on the press adjacent the plate cylinder;

a form roller rotatably supported in said frame for contact with a plate on the plate cylinder;

a metering roller in pressure contact with said form roller on the opposite side thereof from the plate cylinder and forming with said form roller a nip reservoir for the liquid;

bearings in said frame supporting said metering roller along a fixed axis parallel to the plate cylinder and spaced therefrom by a distance less than the diameter of said form roller;

spaced apart guide means on said frame arranged parallel to a tangent to said plate cylinder and extending along a path located between said metering roller and the plate cylinder;

bearings in said guide means receiving the ends of said form roller;

means acting on said guide means to move said form roller in a direction tangent to the plate cylinder and toward and away from said metering roller for urging said metering roller and said form roller into pressure contact without affecting the contact of said form roller with a plate on the plate cylinder;

means providing a supply of liquid to said reservoir whereby liquid in said reservoir is continually replenished; and drive means rotating the plate cylinder, said form roller and said metering roller at one-to-one surface speed with each other.

9. An apparatus for coating sheets fed through an offset lithographic printing press having a plate cylinder, the apparatus comprising:

a frame adapted for mounting on the press adjacent the plate cylinder;

a generally smooth plate mounted to the plate cylinder;

a form roller rotatably supported in said frame for contact with said plate on the plate cylinder;

a metering roller rotatably supported in said frame in pressure contact with said form roller and on the opposite side thereof from the plate cylinder and forming with said form roller a reservoir for coating liquid;

said form roller and said metering roller having liquid receptive surfaces and the surface of said metering roller being substantially less resilient than the surface of said form roller;

means for urging said form roller into contact with said plate on the plate cylinder;

means urging said metering roller and said form roller into pressure contact with each other; and means providing a supply of coating liquid to said reservoir whereby liquid in said reservoir is continually picked up from said plate by the action of the metering and form rollers and the liquid is applied to the plate by said form roller;

means for adjusting the pressure contact between said metering roller and said form roller without changing the pressure contact between said form roller and the plate cylinder;

drive means rotating said plate cylinder and said metering roller at one-to-one surface speed with each other; and said form roller being driven from frictional contact with said plate cylinder and said metering roller.

10. The apparatus for an offset press as defined in claim 9, further comprising:

a shaft supporting said metering roller;

bearing means supporting said metering roller in said frame with portions of said shaft extending outwardly from said frame;

a pair of mounting brackets adapted for attachment to frame members of the press;

a bearing in each of said brackets receiving an end of said shaft to provide a mounting for said frame coincident with the axis of said shaft.

11. The apparatus for an offset press as defined in claim 9, further comprising:

slots formed in said frame arranged parallel to a tangent to said plate cylinder;

blocks slidably mounted in said slots;

bearings in said blocks receiving the ends of said form roller;

bearings supported in said frame and receiving ends of said metering roller in spaced relation to said slots;

control rods attached to said blocks; and said means for adjusting the pressure contact between said metering roller and said form roller including means acting on said control rods to move said blocks in a direction to move the axis of said form roller toward and away from the axis of said metering roller.

* * * * *